US005539443A

United States Patent [19]

Mushika et al.

[11] Patent Number: 5,539,443

[45] Date of Patent: Jul. 23, 1996

[54] PRINTER UTILIZING TEMPERATURE EVALUATION AND TEMPERATURE DETECTION

[75] Inventors: Yoshihiro Mushika, Neyagawa; Yasuki Matsumoto, Takarazuka; Haruo Yamashita, Osaka, all of Japan

[73] Assignee: Matsushita Electric Industrial Co., Ltd., Osaka-fu, Japan

[21] Appl. No.: 84,954

[22] Filed: Jul. 2, 1993

[30] Foreign Application Priority Data

Jul. 3, 1992 [JP] Japan ..... 4-175822

[51] Int. Cl.[6] ..... B41J 2/365

[52] U.S. Cl. ..... 347/194; 358/298; 347/183

[58] Field of Search ..... 347/183, 188, 347/194; 400/120.14; 358/298

[56] References Cited

U.S. PATENT DOCUMENTS 4,827,281 5/1989 Lubinsky et al. .
5,006,866 4/1991 Someya .
5,066,961 11/1991 Yamashita .
5,162,813 11/1992 Kuroiwa et al. .

FOREIGN PATENT DOCUMENTS 59-127781 7/1984 Japan .
63-89359 4/1988 Japan .
3207675 9/1991 Japan .

*Primary Examiner*—Huan H. Tran
*Attorney, Agent, or Firm*—Wenderoth, Lind & Ponack

[57] ABSTRACT

A printer for recording a multitone image in which pulse width correction data is generated based on a temperature output of a thermistor for detecting the temperature of a head mount of a thermal head and an output of a data cumulating circuit for cumulating pulse width data inputted to the thermal head; and an adding circuit which adds the pulse width data to an output obtained by conversion, from inputted tone data, made by a γ correcting circuit, thus accomplishing a temperature compensation. The temperature compensation constants necessary for calculating pulse width correction data are also determined.

9 Claims, 14 Drawing Sheets

PRINTER UTILIZING TEMPERATURE EVALUATION AND TEMPERATURE DETECTION

BACKGROUND OF THE INVENTION

1. Field of the Invention

The present invention relates to a printer of a thermal transfer type and more particularly to a printer for recording a multitone image.

2. Description of the Related Arts

A thermal transfer printing system can more readily deal with colors and can be made more compact than other printing systems like an ink-jet system or an electophotographic system, and because of its further advantages in image quality, cost, and maintenance, this system is widely applied to hard copy apparatus which record pictorial images.

Especially, a thermal transfer recording method which uses sublimating dye ink as thermosensible ink is suitable for recording a pictorial image. This method utilizes the characteristic of the sublimating dye that the amount of the dye to be transferred to the recording paper continuously changes according to the amount of a heating. Consequently, control of the recording density of a multitone image is possible by modulating the width of pulses to be supplied to a heating element of a thermal head. This density control method is superior to other density control methods such as a dither method or density pattern method with respect to forming a multitone image without a reduction in the resolution.

However, such a sublimation dye thermal transfer printer, which performs density control by the current pulse width modulation, has its recording density dependent on the ambient temperature, and it is therefore difficult to reproduce the density of the image correctly.

In full color recording, normally, the primary colors of yellow (Y), magenta (M), and cyan (C) are recorded one by one on one image plane, and the recording paper is rewound three times so as to superimpose recorded images of the three colors on each other. Unless the density of each color is correctly reproduced, the color of each pixel obtained by the mixture of the primary colors is different from a target color. Therefore, it is necessary to develop a temperature compensating technique to reproduce the density of the image by controlling the energy to be applied to the printer according to temperature so as to form an image of high quality.

In addition to the change in environmental temperature, the temperature rise (heat reserve) of the thermal head itself during the recording of the image is also a cause of a temperature change. Although heat generated in the heating element of the thermal head during the image recording is partly transmitted to an ink film, the generated heat is mostly transmitted to a head mount via a substrate of the heating element. As a result, during recording, there always exists nonconstant temperature distribution in a thermal head according to the input recording signals.

The temperature measurement for temperature compensation is carried out by a temperature measuring element such as a thermistor installed in the head mount spaced a certain distance from the heating element in order to prevent the measuring operation from giving a bad influence on the image recording. This is not enough to follow a temperature change in a portion disposed in the vicinity of the heating element such as the substrate of the heating element in response to recording signals. To cope with this problem, a temperature compensating method having a prompt response to the temperature change has been proposed.

According to U.S. Pat. No. 5,066,961, the temperature of the substrate of the heating element is evaluated based on the measured temperature of the head mount of the thermal head and energy applied to the heating elements from the first line until a preceding line so as to calculate a compensation coefficient from the temperature of the substrate of the heating element. Then, the compensation coefficient is multiplied by the pulse width data. In this manner, a temperature compensation is carried out.

In the above-described apparatus, temperature compensation is performed by multiplying the compensation coefficient by the pulse width data. This method has, however, a problem that during the high speed recording, a temperature compensation cannot be accomplished accurately. Therefore, the density of the multitone image cannot be recorded favorably when a temperature has changed.

SUMMARY OF THE INVENTION

It is therefore an object of the present invention to provide a printer capable of accomplishing a temperature compensation with a high accuracy.

In accomplishing these and other objects, there is provided a printer for recording a multitone image for each printing line comprising: a $\gamma$ correcting means for converting tonal data including at least one of density data and luminance data supplied thereto into corresponding first pulse width data required to obtain a predetermined recording density; a data correcting means for converting the first pulse width data into second pulse width data obtained by at least adding pulse width correction data to the first pulse width data; a thermal head comprising a plurality of heating elements formed on a supporting member; head a driving means for driving each of the heating elements of the thermal head according to the second pulse width data; a temperature detection means for providing an output representing a temperature in a portion of the supporting member of the thermal head; a data cumulating means for providing an output obtained by cumulating data, substantially corresponding to the second pulse width data, for each printing line; and a correction data determining means for determining at least the pulse width correction data based on the output of the temperature detection means and that of the data cumulating means.

According to the above construction, the data correcting means adds the pulse width correction data to the output of the $\gamma$ correcting means. Therefore, the printer is capable of providing a temperature compensation with a high accuracy.

BRIEF DESCRIPTION OF THE INVENTION

These and other objects and features of the present invention will become clear from the following description taken in conjunction with the preferred embodiments thereof with reference to the accompanying drawings, in which.

Figure 2A:
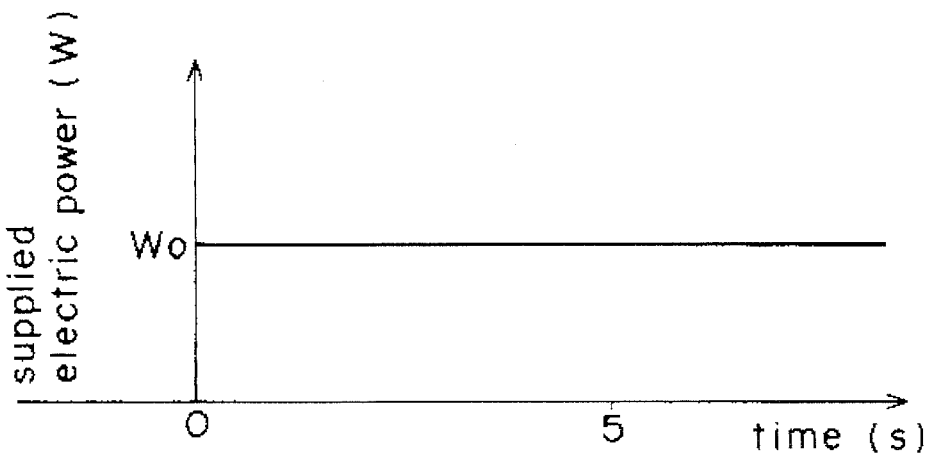
Figure 3:
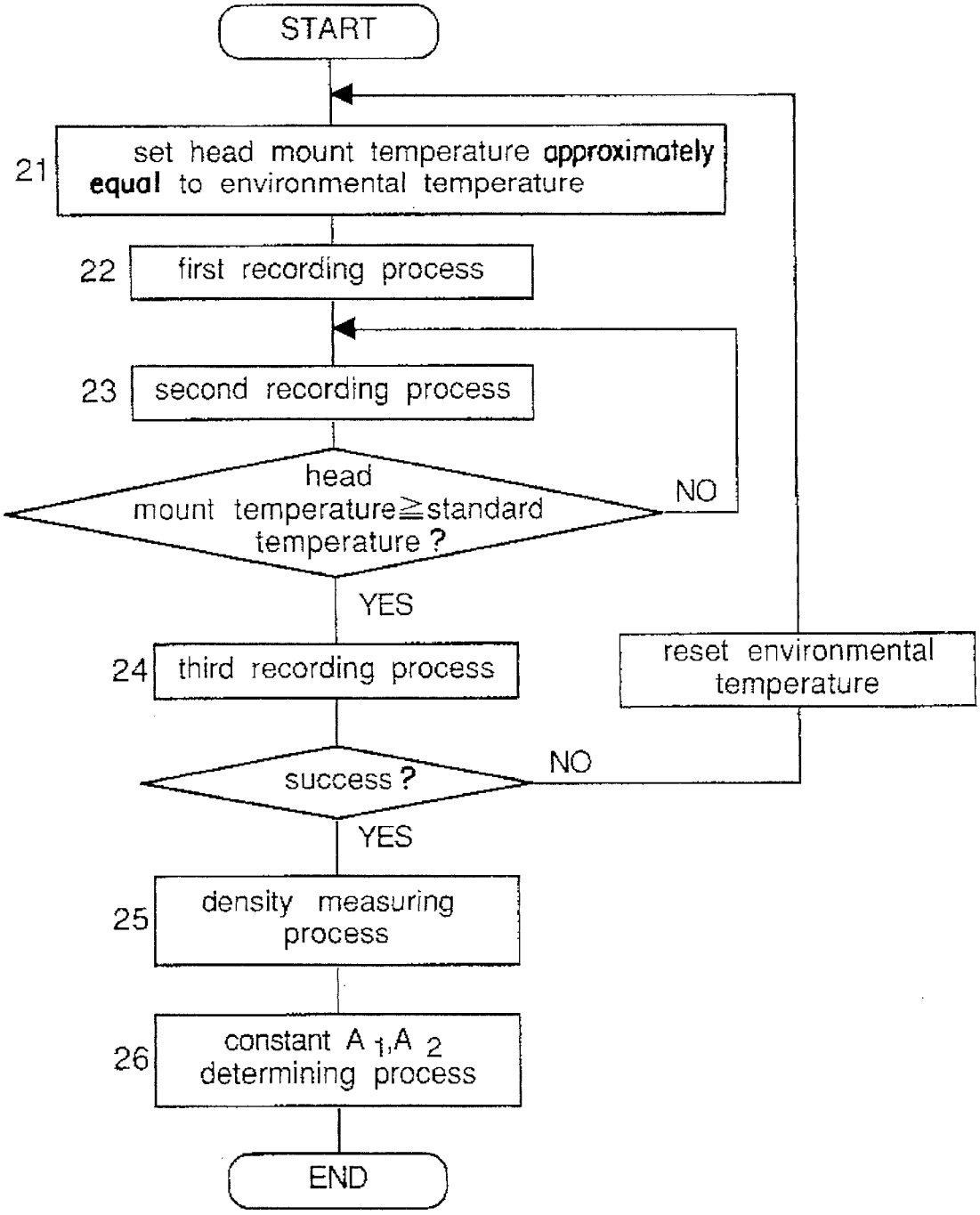
Figure 4A:
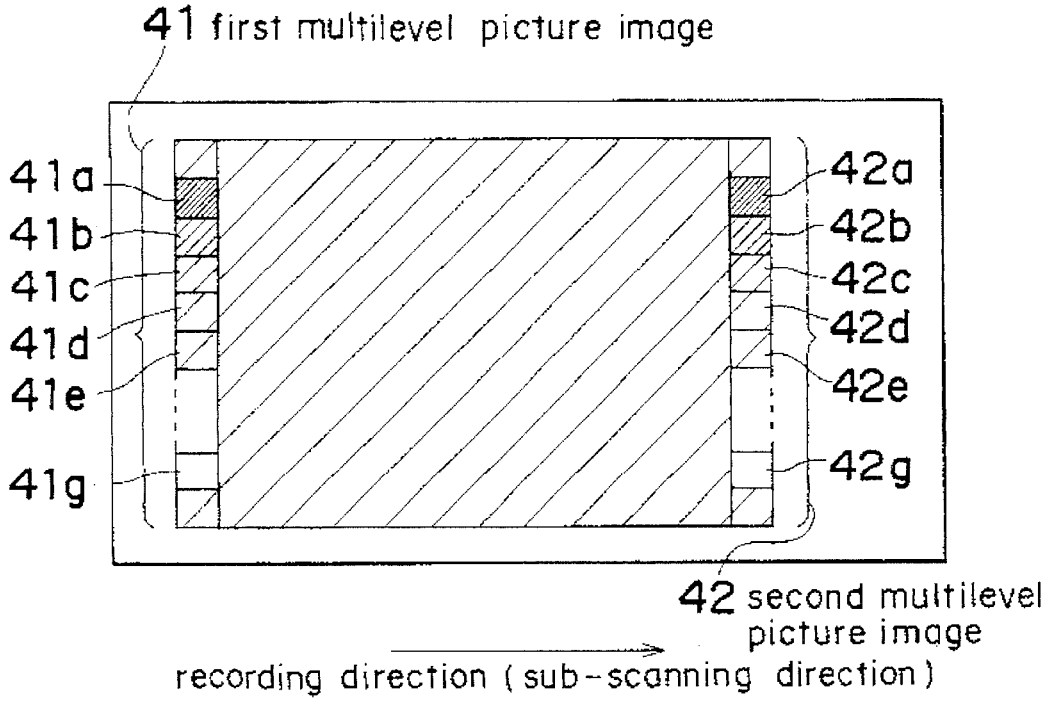

FIGS. 2(A) and (B), is a view showing a method of determining temperature compensating constants $\alpha$ and $A_3$ according to the first embodiment of the present invention;

FIG. 3 is a flowchart showing a process of determining temperature compensating constants $A_1$ and $A_2$ according to the first embodiment of the present invention;

FIG. 4(A) shows a recorded image obtained in the recording process.

Figure 4B:
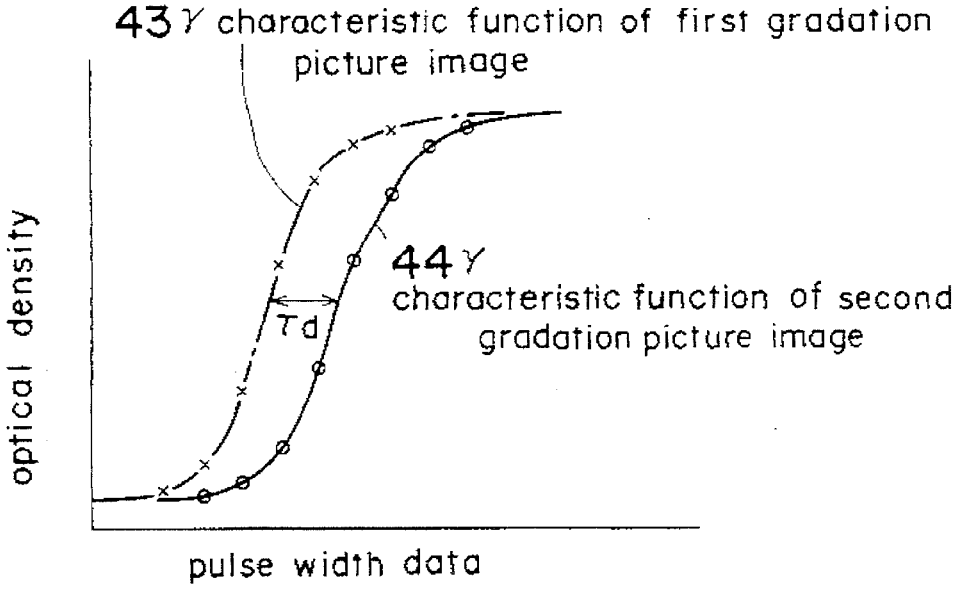
Figure 5A:
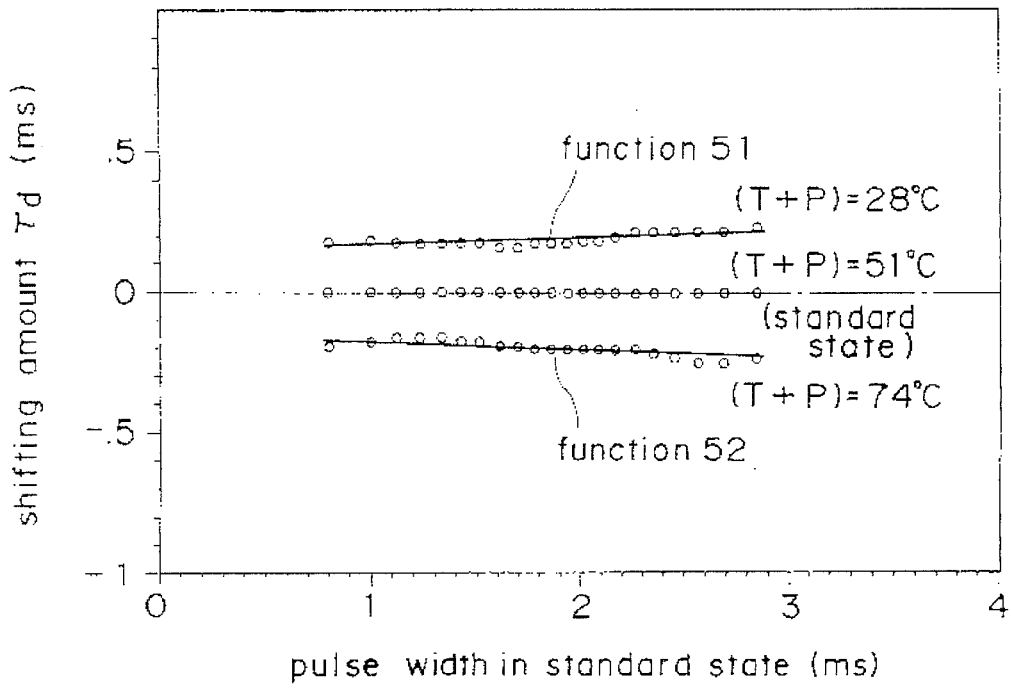
Figure 5B:
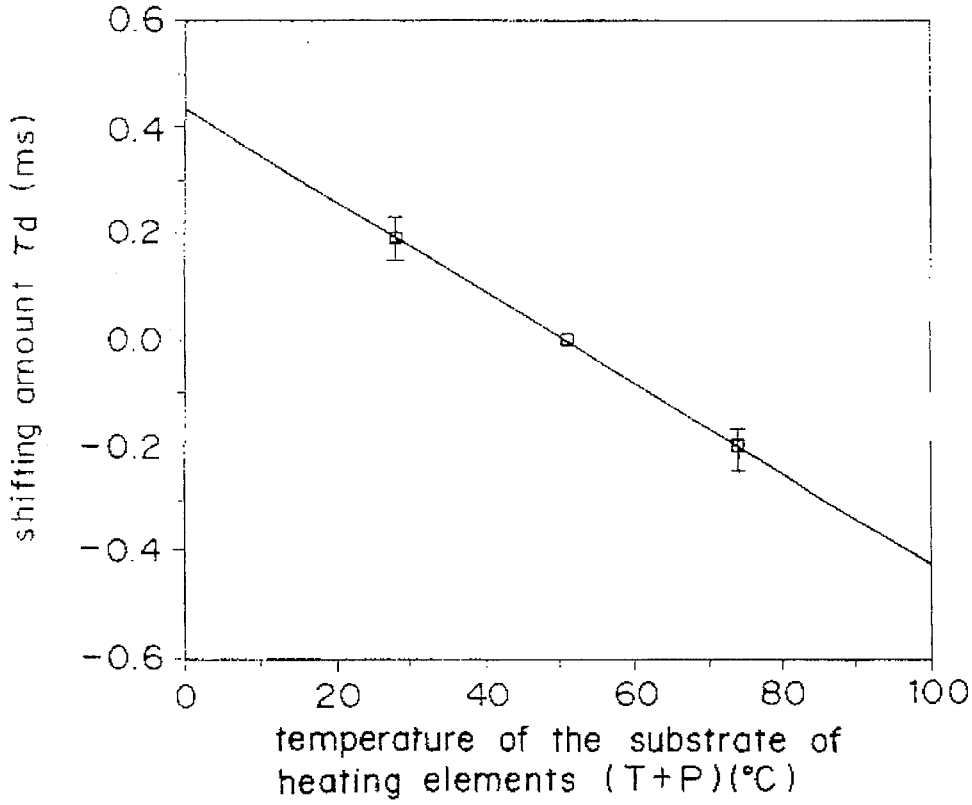
Figure 6A:
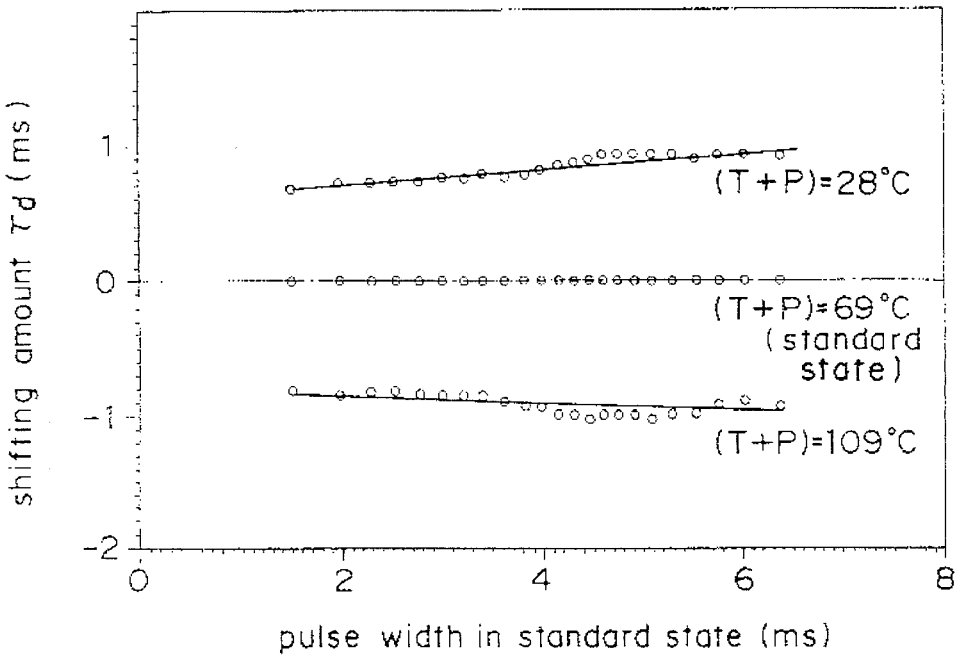
Figure 6B:
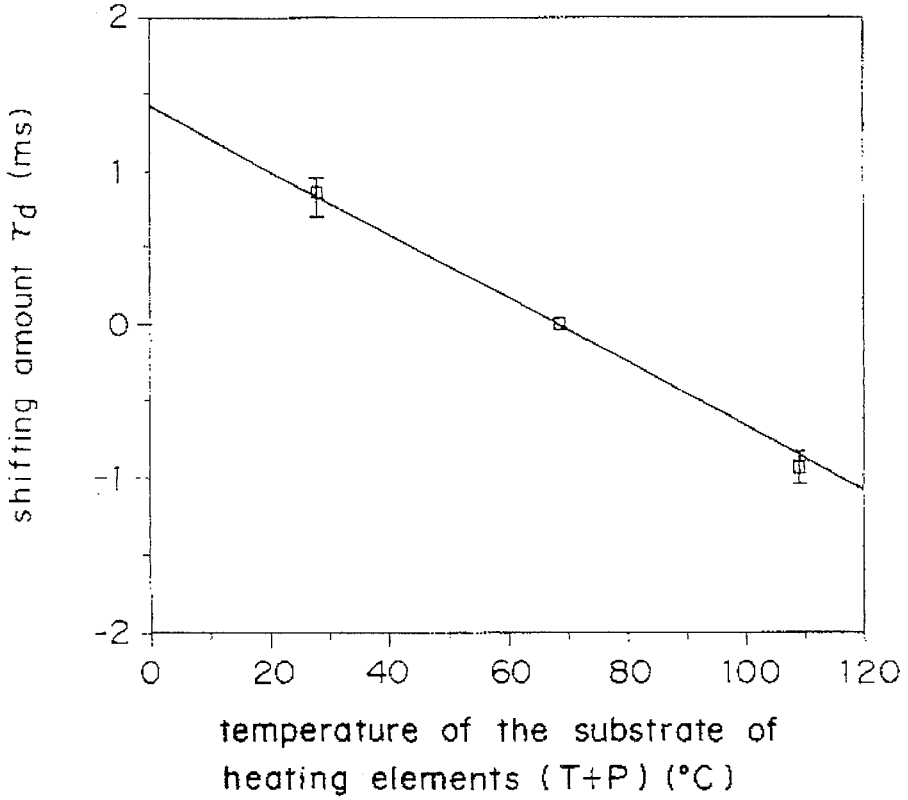
Figure 7A:
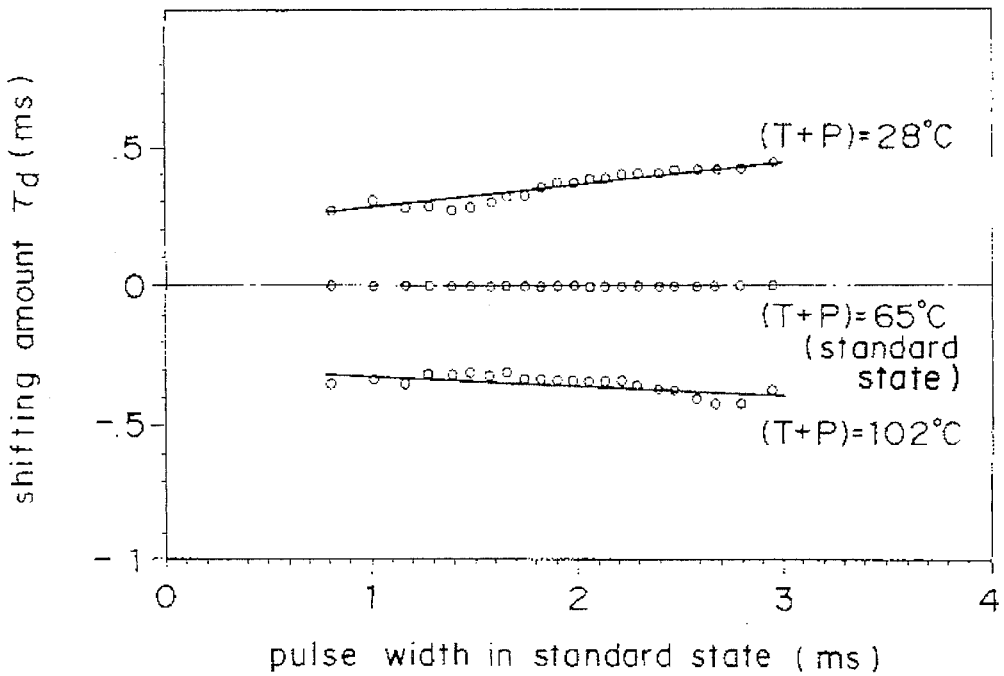
Figure 7B:
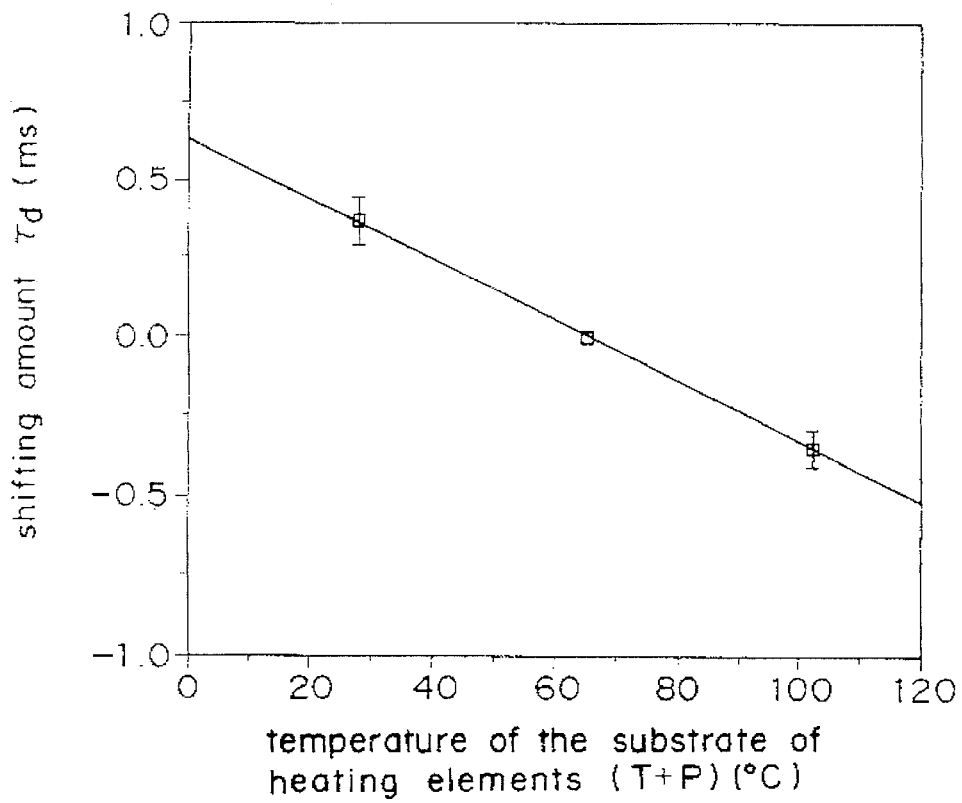
Figure 8A:
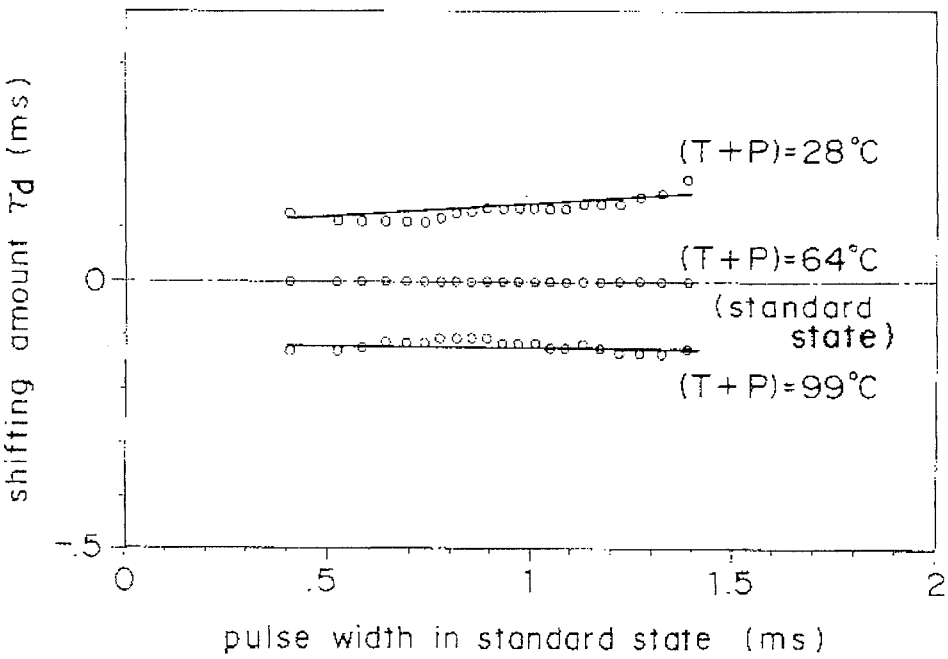
Figure 8B:
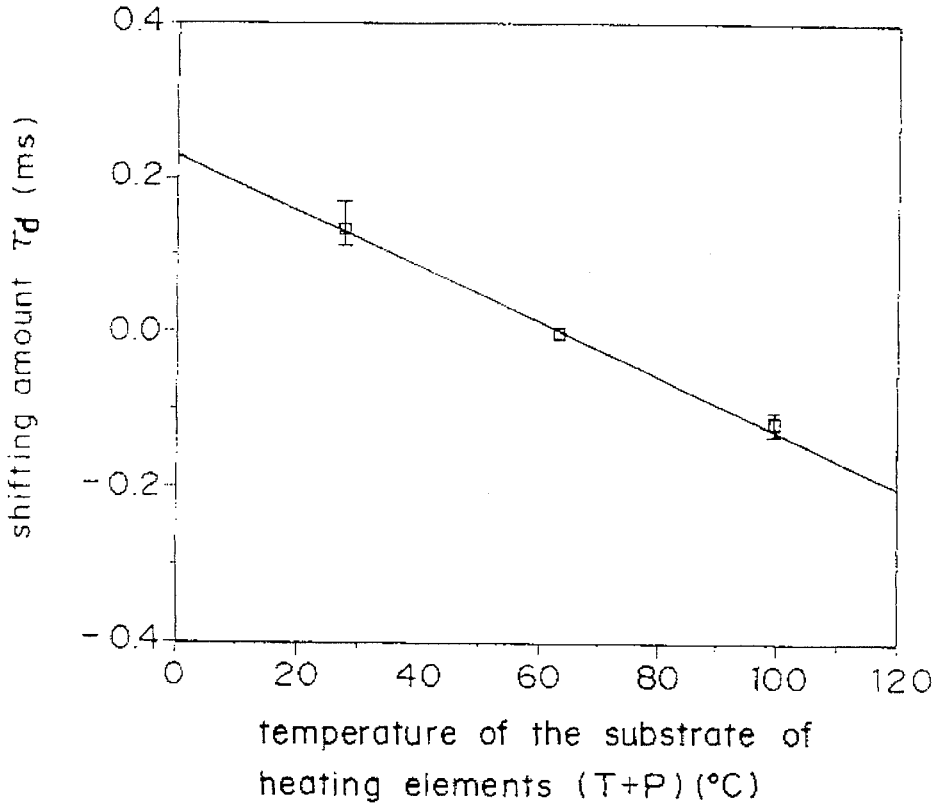
Figure 9A:
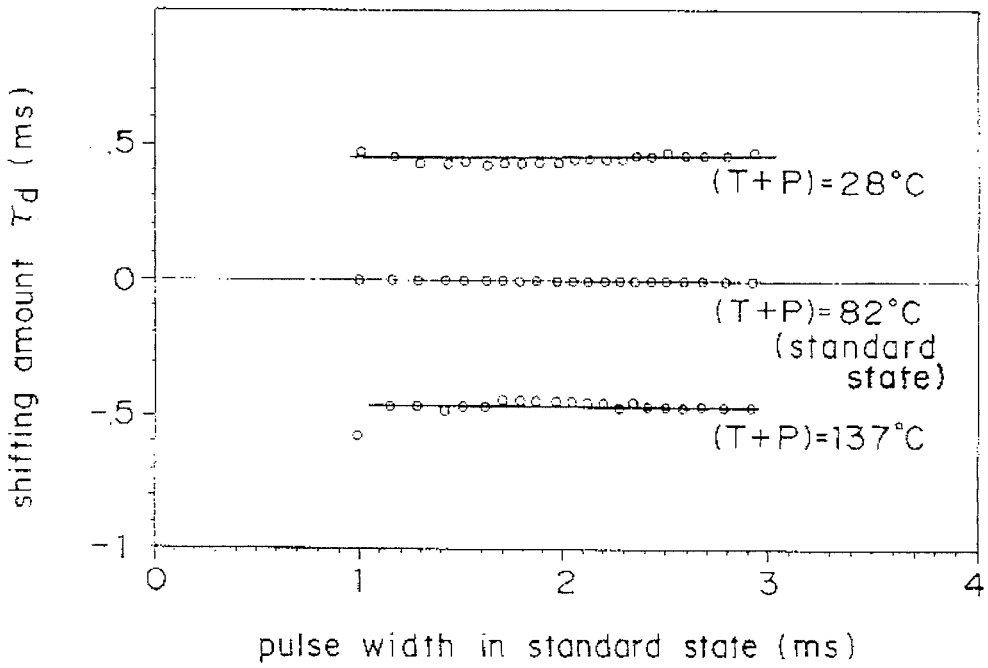
Figure 9B:
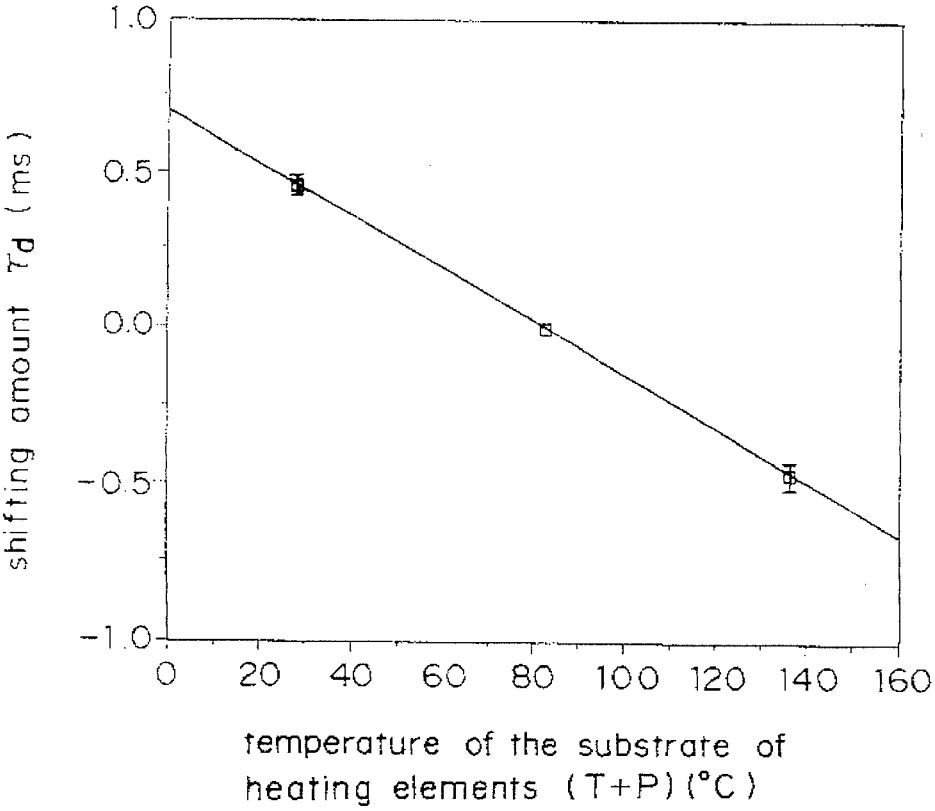
Figure 10A:
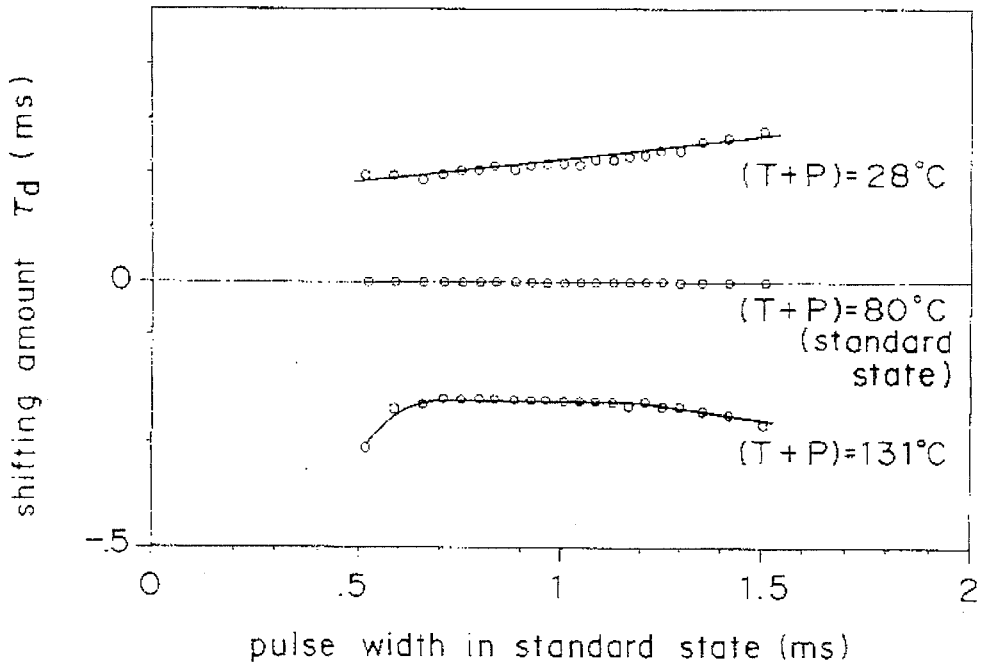
Figure 10B:
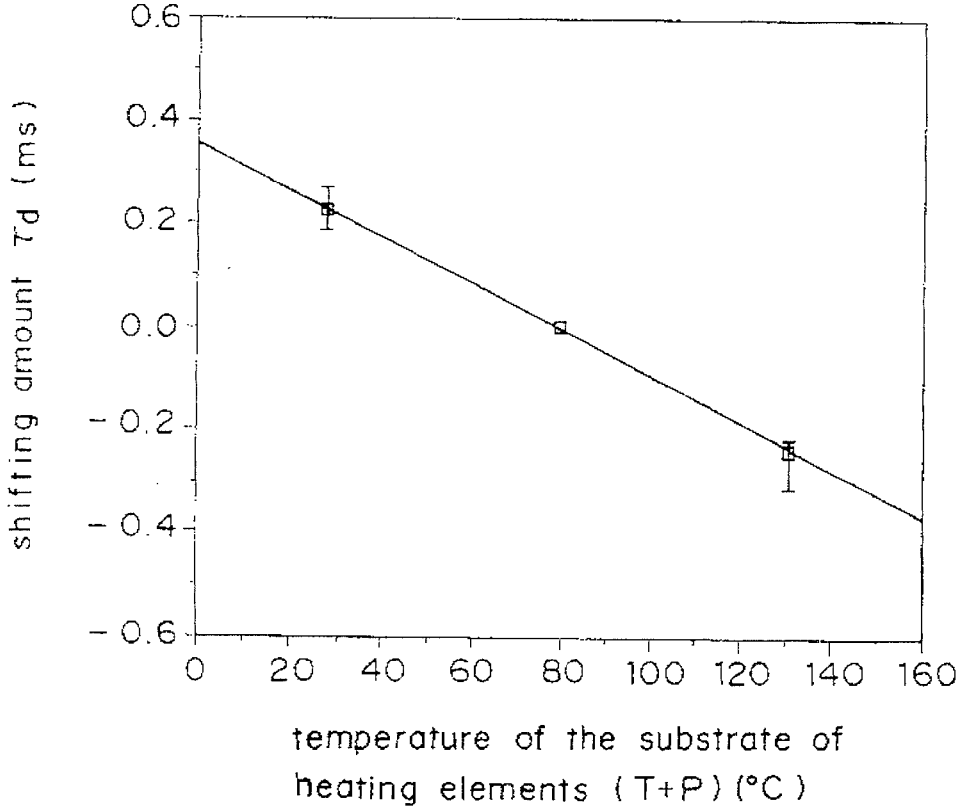
Figure 11A:
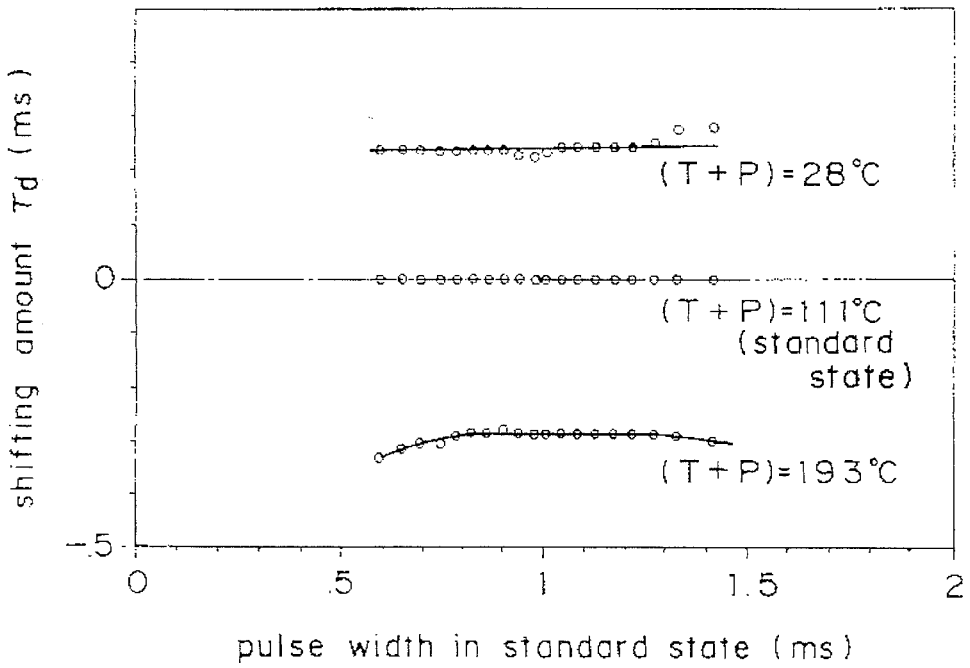
Figure 11B:
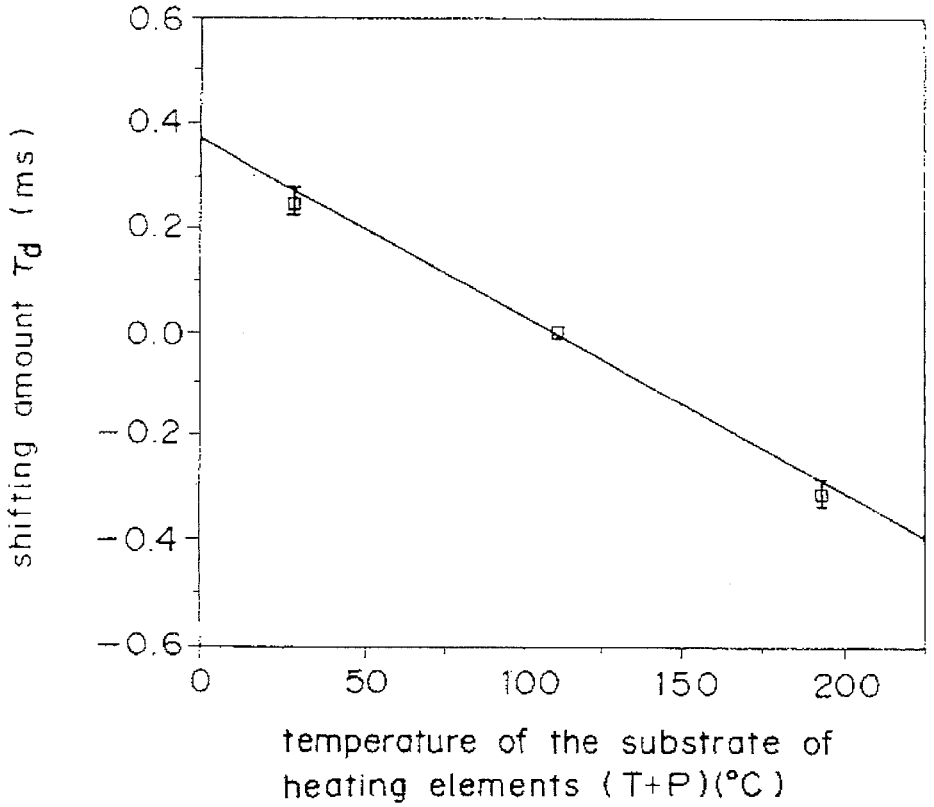
Figure 12A:
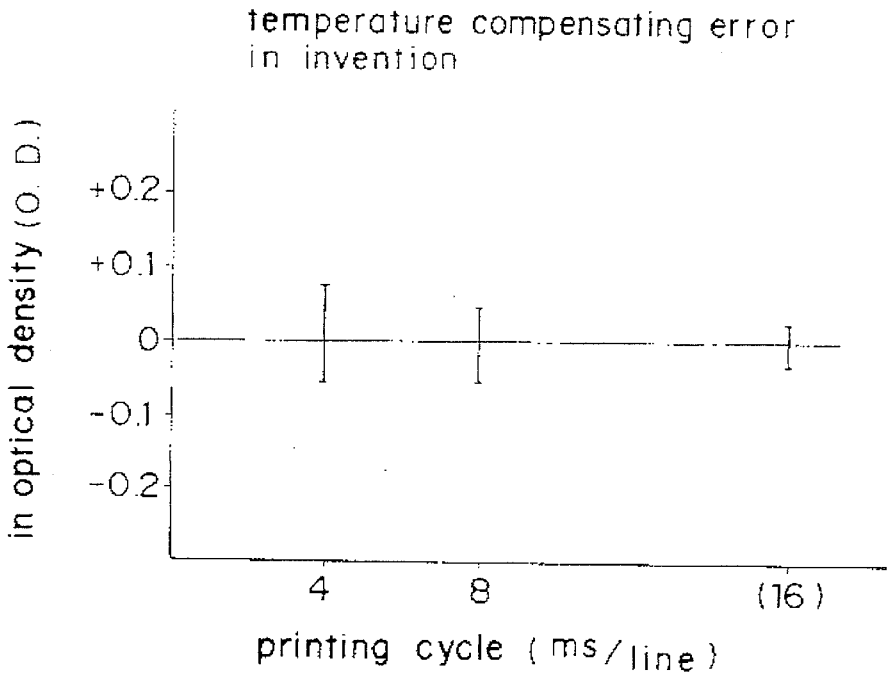
Figure 13:
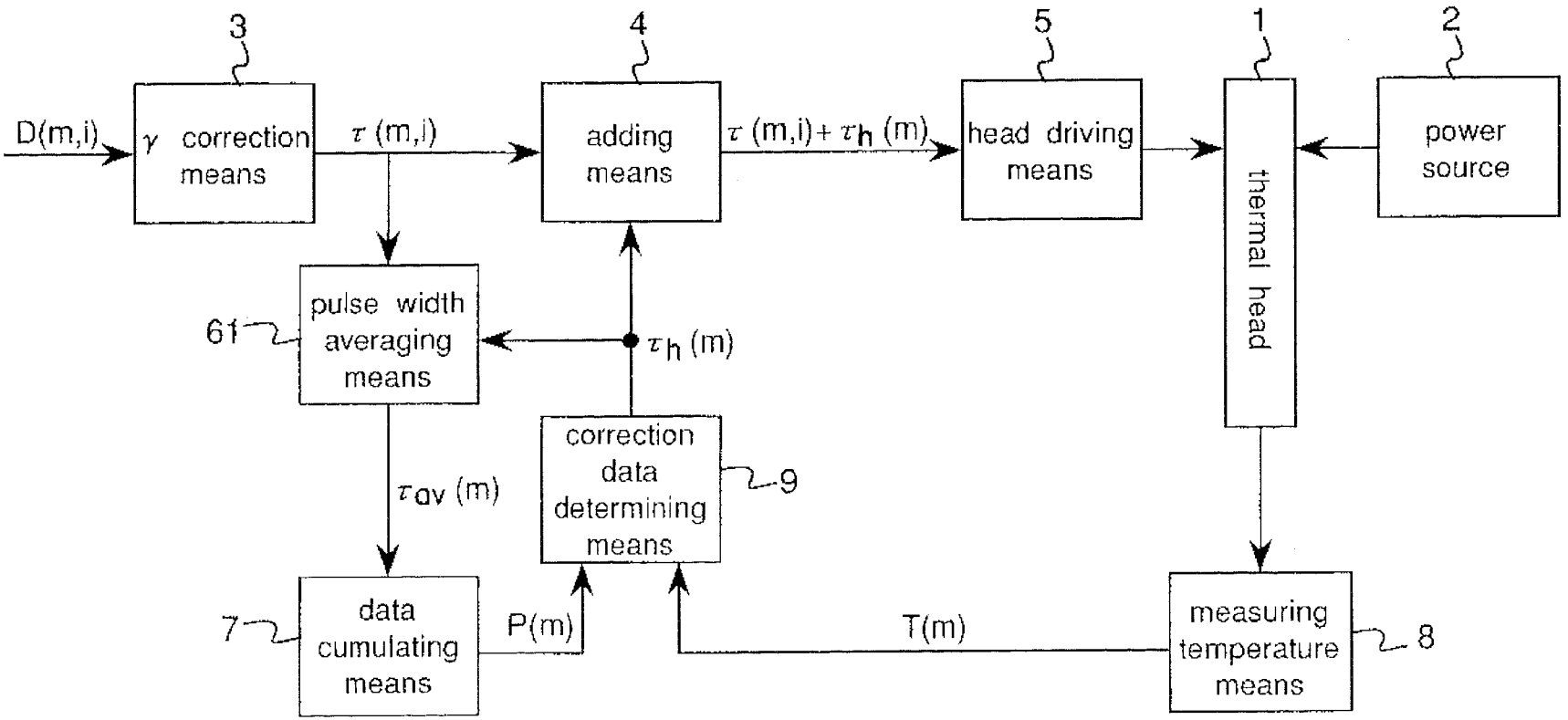
Figure 14:
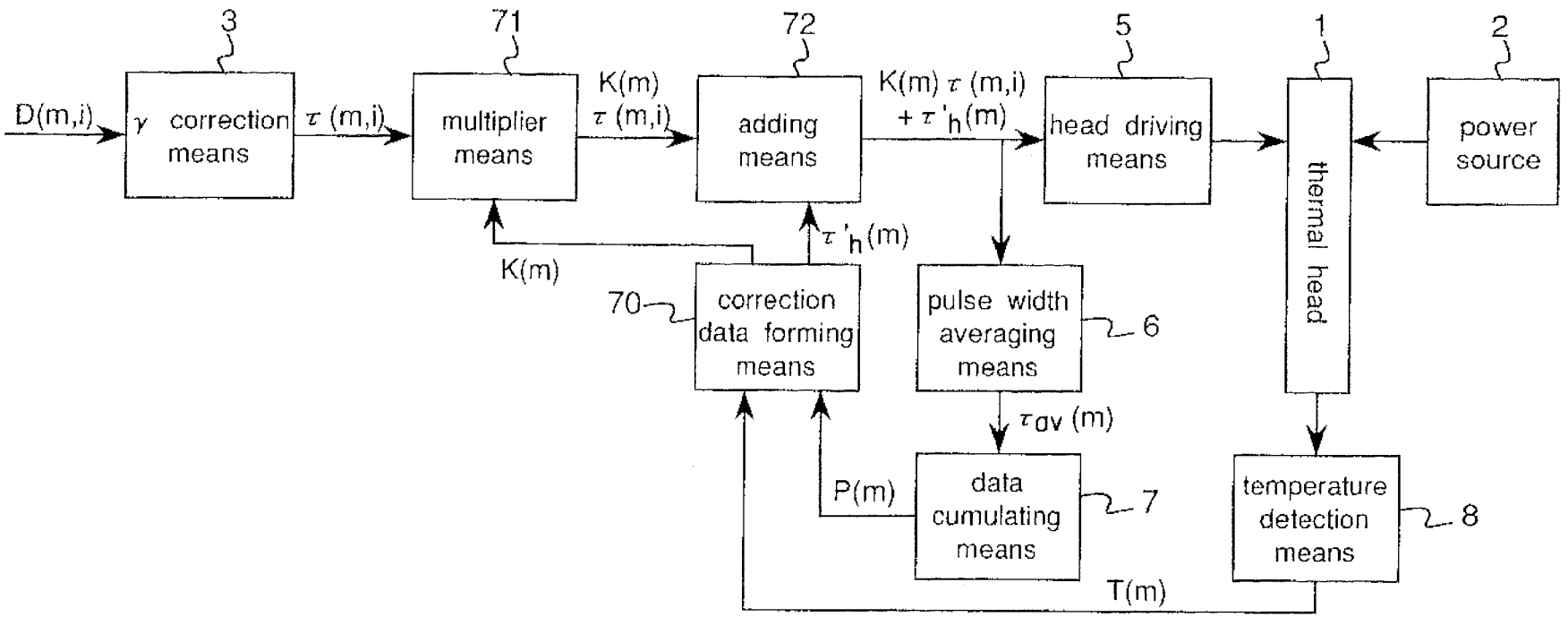

FIG. 4(B), is an explanatory view showing a method of determining temperature compensating constants $A_1$ and $A_2$ according to the first embodiment of the present invention;

FIGS. 5(A) and 5(B), are is an explanatory views of an experimental result showing the characteristic of a shift amount $\tau_d$ under a first recording condition (printing cycle: 16 ms, maximum pulse width: 4 ms) according to the first embodiment of the present invention;

FIGS. 6(A) and 6(B) are explanatory view of an experimental result showing the characteristic of a shift amount $\tau_d$ under a second recording condition (printing cycle: 8 ms, maximum pulse width: 8 ms) according to the first embodiment of the present invention;

FIGS. 7(A) and (B) are explanatory views of an experimental result showing the characteristic of a shift amount $\tau_d$ under a third recording condition (printing cycle: 8 ms, maximum pulse width: 4 ms) according to the first embodiment of the present invention;

FIGS. 8(A) and (B) are explanatory view of an experimental result showing the characteristic of a shift amount $\tau_d$ under a fourth recording condition (printing cycle: 8 ms, maximum pulse width: 2 ms) according to the first embodiment of the present invention;

FIGS. 9(A) and (B) are explanatory view of an experimental result showing the characteristic of a shift amount $\tau_d$ under a fifth recording condition (printing cycle: 4 ms, maximum pulse width: 4 ms) according to the first embodiment of the present invention;

FIGS. 10(A) and (B) are explanatory views of an experimental result showing the characteristic of a shift amount $\tau_d$ under a sixth recording condition (printing cycle: 4 ms, maximum pulse width: 2 ms) according to the first embodiment of the present invention;

FIGS. 11(A) and (B) are explanatory views of an experimental result showing the characteristic of a shift amount $\tau_d$ under a seventh recording condition (printing cycle: 2 ms, maximum pulse width: 2 ms) according to the first embodiment of the present invention;

FIGS. 12(A) and (B) are explanatory views in which a comparison is made between a correction error of the printer according to the first embodiment of the present invention and of a conventional printer;

FIG. 13 is a block diagram showing the construction of a printer for recording a multitone image according to a second embodiment of the present invention; and FIG. 14 is a block diagram showing the construction of a printer for recording a multitone image according to a third embodiment of the present invention.

DETAILED DESCRIPTION OF THE INVENTION

Before the description of the present invention proceeds, it is to be noted that like parts are designated by like reference numerals throughout the accompanying drawings.

Figure 1A:
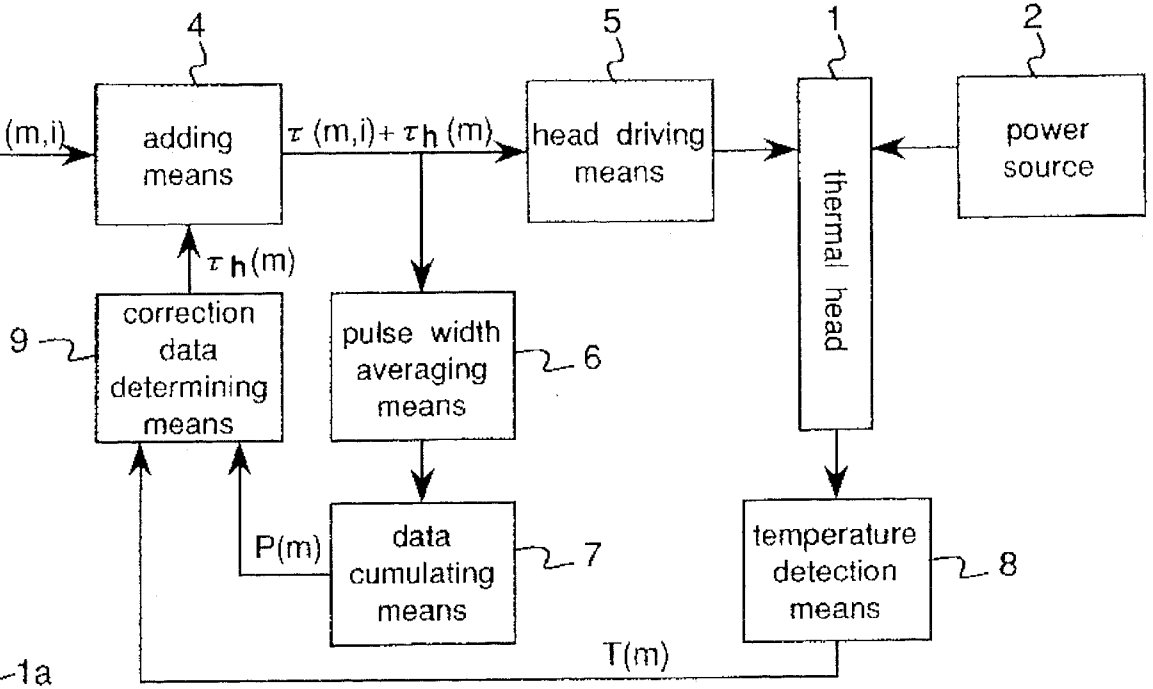
FIG. 1(A), is a block diagram showing the construction of a printer for recording a multitone image according to a first embodiment of the present invention.

A printer according to a first embodiment of the present invention is described below with reference to FIGS. 1(A) through 12. FIG. 1(A) is a block diagram showing the construction of the printer according to the first embodiment of the present invention. The printer records the density of a multitone image faithfully in response to input density data and records the tone of the multitone image by means of thermosensible recording method, with a pulse width controlled.

Referring to FIG. 1(A), the printer comprises a thermal head 1; a power supply 2; a $\gamma$ correcting means 3; an adding means 4; a head driving means 5; a pulse width averaging means 6; a data cumulating means 7; a temperature detection means 8; and a correction data determining means 9. The thermal head 1 comprising (n) (n is an integer more than b) heating elements arranged in a line records the image for each line at a constant printing cycle. The power supply 2 supplies power to the thermal head 1. In an m-th printing line (m is an integer more than b), the $\gamma$ correcting means 3 converts printing tone data D(m, i) of each heating element (i) (i=1~n) into corresponding pulse width data $\tau$(m, i). The pulse width data $\tau$(m, i) corresponds to the first pulse width data. The $\gamma$ correcting means 3 comprises an ROM table. Upon input of an address corresponding to the tone data to the ROM table, a pulse width necessary for recording the image density indicated by the tone data is read. The correspondence between the pulse width data and the tone data has been experimentally found at a certain temperature condition, which is defined as a standard state. In order to set the printer in the standard state, a predetermined pulse width $\tau_0$ is repeatedly applied to each heating element in each printing line. As a result, the temperature T of a head mount of the thermal head 1 becomes the reference temperature $T_{st}$ when the heat cumulation of the substrate of the heating element has been saturated, in other words, when a difference between the temperature of the substrate and of the head mount has reached a constant value. The following data inputted to the $\gamma$ correcting means 3 may be also used as the tone data D(m, i): density data corresponding to the component of each of the primary colors Y, M, and C or luminance data corresponding to the component of each of the complementary colors R, G, and B.

In response to the first pulse width data $\tau$(m, i) outputted from the $\gamma$ correcting means 3, the adding means 4 adds pulse width correction data $\tau_h$(m) determined by the correction data determining means 9 to the first pulse width data $\tau$(m, i), thus outputting second pulse width data $\tau$(m, i)+$\tau_h$(m) to the head driving means 5. It is to be noted that the adding means 4 corresponds to the data correcting means. In proportion to the second pulse width data $\tau$(m, i)+$\tau_h$(m), the head driving means 5 sets the period of time in which electrical power is supplied to the heating element (i) disposed in the m-th line.

The pulse width averaging means 6 totals the pulse width data {$\tau$(m, 1)+$\tau_h$(m)_$\tau$(m, n)+$\tau_h$(m)}, of all pixels existing in one line, outputted from the adding means 4 and takes an average value thereof, thus outputting averaged pulse width data $\tau_{av}$(m) to the totaling means 7. In response to the averaged pulse width data $\tau_{av}$(m) outputted from the pulse width averaging means 6, the data cumulating means 7 cumulates the averaged pulse width data $\tau_{av}$(m) for each line by using a recurrence formula of equation 1, thus outputting the cumulated data P(m) to the correction data determining means 9.

$$P(m)=\alpha\cdot P(m-1)+(1-\alpha)\cdot A_3\cdot\tau_{av}(m-1) \quad \text{(equation 1)}$$

where $\alpha$ is a constant greater than 0 and smaller than 1; $A_3$ is a constant, and P(0)=0.

The recurrence formula of equation 1 is equivalent to an equation of equation 2. Therefore, the cumulated data P(m) of the m-th line could also be obtained by weighting the averaged pulse width data $\tau_{av}(m)$ and cumulating the output of the pulse width averaging means 6 for each of the first line through a (m−1)th line.

$$P(m) = (1-\alpha)\cdot A_3 \cdot \sum_{j}^{m-1} \tau_{av}(j)\cdot \alpha^{m-j-1} \quad \text{(equation 2)}$$

where $\alpha$ is a constant greater than 0 and smaller than 1; $A_3$ is a constant, and P(0)=0.

The data cumulating means includes the pulse width averaging means 6 and the data cumulating means 7.

The temperature detection means 8 comprises a thermistor embedded in the thermal head 1 and a converting means for converting the resistance value of the thermistor into temperature data, thus outputting the temperature T(m) of the head mount for each printing line. The correction data determining means 9 calculates the pulse width correction data $\tau_h(m)$ based on the output T(m) of the temperature detection means 8 and the output P(m) of the data cumulating means 7 by using an equation 3 shown below.

$$\tau_h(m)=A_1\cdot(T(m)+P(m))+A_2 \quad \text{(equation 3)}$$

where $A_l$ and $A_2$ are constant.

The cumulated data P(m) of equation 3 indicates an estimated value of the difference between the temperature of the substrate of the heating element and that of the head mount. Therefore, {T(m)+P(m)} means an estimated value of the temperature of the substrate.

Figure 1B:
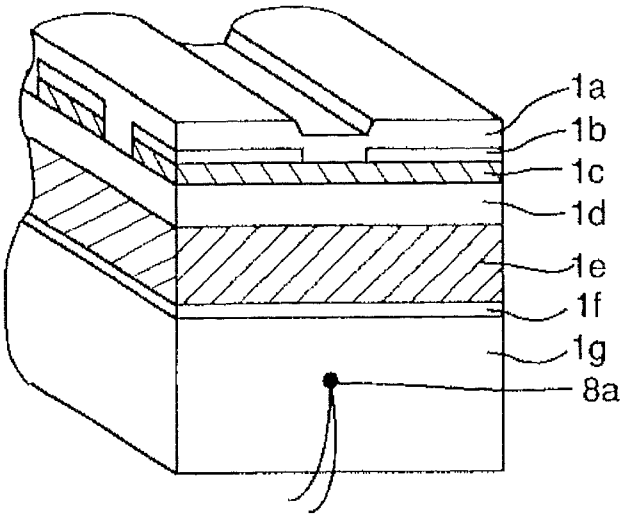
FIG. 1B is a partial sectional view showing the construction of the thermal head of FIG. 1(A).

FIG. 1(B) is a partial sectional view showing the construction of the thermal head 1. The thermal head 1 comprises a substrate 1*e* of a heating element, made of $Al_2O_3$; a glaze layer 1*d* formed on the substrate 1*e*; the heating element 1*c* formed on the glaze layer 1*d* by sputtering; an electrode 1*b* connected to the glaze layer 1*d*; and a protecting layer 1*a* for protecting the upper surface of the thermal head 1. The substrate 1*e* of the heating element 1*c* is installed on a head mount 1*g* via an adhesive layer 1*f*. A thermistor 8*a* composing the temperature measuring means 8 is embedded in the head mount 1*g*. The printer having the above-described construction records the image by performing a temperature compensation for each line.

Figure 2B:
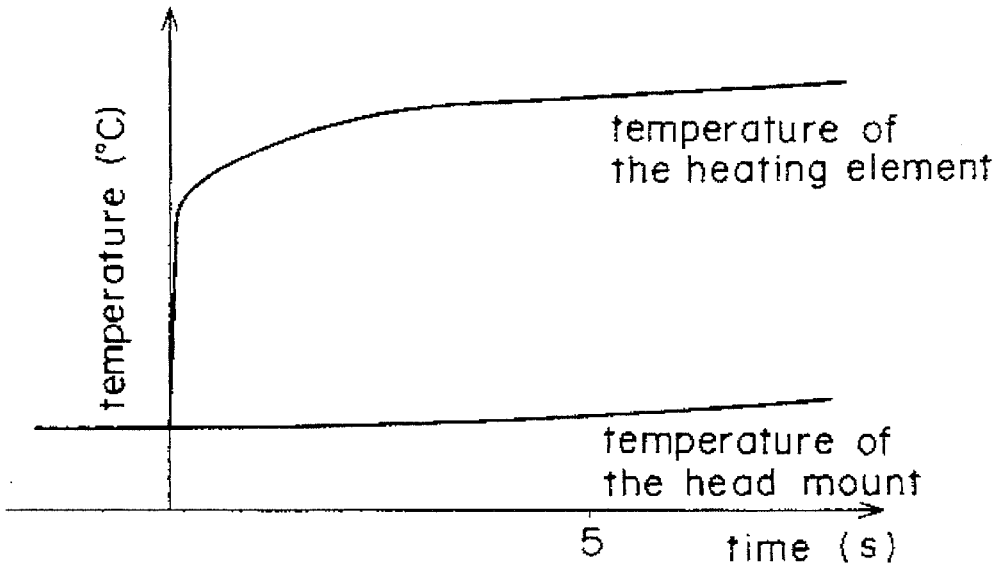

The method for determining the constants $\alpha$, $A_1$, $A_2$, and $A_3$ is described below. FIGS. 2(A)–2(b) show a heat response of the heating element. As shown in FIG. 2(A), electric power $W_0$ is applied stepwise to each of the heating elements of the thermal head from a time t=0 so as to measure the temperature of each heating element by means of a radiation thermometer or TCR method (a temperature measuring method utilizing the change of the resistance value of the heating element with respect to temperature) and also measures the temperature of the head mount 1*g* by means of the thermistor. The electric power $W_0$ is applied to all the heating element 1*c* for a long time (more than several seconds) until the rise ratio of the temperature of the heating element 1*c* becomes almost equal to that of the temperature of the head mount 1*g*. The graph shown in FIG. 2(B) indicates the result of the application of the electric power $W_0$ to the heating element 1*c*. Then, the indential response of the temperature $T_h(t)$ of the heating element 1*c* is given by an approximate expression of equation 4 shown below. The constants $C_1$, $C_2$, $R_1$, and $R_2$ are determined so that the approximate equation 4 matches the measured temperature $T_h(t)$ best. Preferably, the objective heating element of the measurement is chosen so it has a resistance value close to the average resistance value of all of the heating elements. The electric power $W_0$ is not necessarily set to be equal to the electric power required in recording an image tone but set to a value lower than that used in recording the image tone. In this manner, the heating element 1*c* can be prevented from being destroyed. In the first embodiment, the indential response of the temperature $T_h(t)$ of the heating element is measured based on the characteristic of the temperature thereof at the rise time thereof when electric power has been applied thereto stepwise, but may be measured based on the characteristic of the temperature thereof at the fall time thereof after electric power is interrupted stepwise.

$$T_h(t) = R_1 W_0\left\{1-\exp\left(\frac{-t}{C_1R_1}\right)\right\} + R_2W_0\left\{1-\exp\left(\frac{-t}{C_2R_2}\right)\right\} + T(t) \quad \text{(Equation 4)}$$

The constants $\alpha$ and $A_3$ are determined based on the constants $C_1$, $C_2$, $R_1$, and $R_2$, the line cycle $\tau_L$ of the printer, and the electric power W applied to the heating element in recording the image tone, by using equations 5 and 6.

$$\alpha = \exp\left(\frac{-\tau_L}{C_2R_2}\right) \quad \text{(Equation 5)}$$

$$A_3 = \frac{R_2}{\tau_L}\cdot W \quad \text{(Equation 6)}$$

Next, a method of determining the constants $A_1$ and $A_2$, is described below. One of the benefits of this method is that $\gamma$ correction data, which is set in the $\gamma$ correcting means, is determined concurrently.

FIG. 3 is a flowchart showing the process of obtaining $\gamma$ correction data and determining the constants $A_1$ and $A_2$. In a process 21, an environmental temperature $T_0$ is set by utilizing a constant-temperature bath and the thermal head 1 is left for a sufficient period of time so as to make the temperature T of the head mount 1*g* equal to the environmental temperature $T_0$. For example, supposing that the reference temperature $T_{st}$ of the head mount 1*g* is set to 30° C., the environmental temperature $T_0$ is set to approximately 26° C. In a first recording process 22, the multitone image is recorded by applying a different pulse width stepwise to a plurality of heating elements in the main scanning direction (direction in which heating elements are arranged) of the thermal head. In a second recording process 23, a solid image is recorded by giving a predetermined pulse width $\tau_0$ to each of the heating elements so that the temperature in the main scanning direction of the thermal head 1 becomes uniform. This operation is repeated until the temperature T of the head mount 1*g* becomes the reference temperature $T_{st}$ (30° C). Preferably, the pulse width $\tau_0$ is about a half of the maximum pulse width, and is equal to the average value of the pulse width given to the heating elements in the first recording process 22. When the temperature T of the head mount 1*g* has become the reference temperature $T_{st}$ (30° C.) in the second recording process 23, the operation of a third recording process 24 is executed. In the third recording process 24, similarly to the first recording process 22, a multitone image is recorded by applying a different pulse width stepwise to a plurality of heating elements in the main scanning direction of the thermal head.

If the period of time required for recording the multitone image made in the second recording process 23, namely, if the period of time t in which the temperature T of the head mount 1*g* becomes the reference temperature $T_{st}$ is greater than a time constant $C_2R_2$, the recording operation terminates. If the period of time t in which the temperature T of the heat release base 1*g* becomes $T_{st}$ is smaller than the time constant $C_2R_2$ or much greater than that and thus if the multitone image cannot be recorded on the recording paper in the third recording process 24, the initialization of the temperature of the head mount 1*g* is altered to record the multitone image again.

In a density measuring process 25, the optical density of each portion of the multitone image recorded in the first and third recording processes 22 and 24 is measured. To this end, the pixel of the first one line is measured by a microdensitometer in the first and third recording processes 22 and 24. It is possible to use a reflection densitometer having a small aperture size (ϕ2~3 mm) so as to measure the density of the pixel in the early stage of the operation of the first and third recording processes 22 and 24. In this way of measurement, almost the same result is obtained. In a process 26, the γ correction data is obtained based on the correspondence between the pulse width data and the density data and in addition, the constants $A_1$ and $A_2$ are determined.

The method of determining the constants $A_1$ and $A_2$ by these processes is described in detail with reference to views of FIGS. 4(A)–4(B). FIG. 4(A) shows a recorded image obtained in the recording process. Reference numeral 41 denotes the first multitone image obtained in the first recording process 22. Reference numeral 41*a* through 41*q* denote regions of the image recorded by applying a different pulse width from 0 to the maximum pulse width to each of b regions. The temperature T of the head mount 1*g* at the time of recording the multitone image is almost equal to the environmental temperature $T_0$, and the cumulated value P is almost zero. Accordingly, the temperature (T+P) of the substrate 1*e* of the heating element of the thermal head 1 is found as $T_0$ at this time. Reference numeral 42 denotes a second multitone image obtained in the second recording process 24. Reference numeral 42*a* through 42*q* denote regions of the image recorded by applying different pulse width, equal to those applied to the regions 41*a* through 41*q*, to each of b regions. The temperature T of the head mount 1*g* at the time of the recording the multitone image is almost equal to the reference temperature $T_{st}$, and the cumulated value P is almost equal to $(\tau_0/\tau_L)\times R_2\times W$. Accordingly, the temperature (T+P) of the substrate 1*e* of the heating element of the thermal head 1 is found as $T_{st}+(\tau_0/\tau_L)\times R_2\times W$. As described previously, this condition is set as the standard state.

FIG. 4(B) is a graph obtained by plotting the correspondence between the pulse width data and the density data based on the measured density of each portion of the recorded multitone image A. Reference numeral 43 denotes a γ characteristic function, of the first multitone image, obtained by an insertion between data by means of interpolation such as spline interpolation, with the correspondence between the pulse width data at b points of the regions 41*a* through 41*q* and the density data plotted. Reference numeral 44 denotes a γ characteristic function, of the second multitone image, obtained by an insertion between data by means of interpolation such as spline interpolation, with the correspondence between the pulse width data at b points of the regions 42*a* through 42*q* and the density data plotted. The γ correction data can be obtained by finding the inverse function of the γ characteristic function 44 at the reference temperature $T_{st}$. The γ correction data is set in the ROM of the γ correcting means 3.

Referring to FIG. 4(B), let it be supposed that the shift amount of the γ characteristic function 43 of the first multitone image with respect to the γ characteristic function 44 of the second multitone image in the abscissa is $\tau_d$ ($\tau_d>0$). The shift amount means the movement amount for making the γ characteristic function 43 of the first multitone image coincident with the γ characteristic function 44 of the second multitone image when the function 43 is moved in parallel along the abscissa.

The shift amount $\tau_d$ is expressed in terms of a recorded density (or pulse width $\tau_d$ in reference state) and the temperature (T+P) of the substrate of the heating element so long as the configuration of the γ characteristic function of the first multitone image 43 and that of the γ characteristic function of the second multitone image 44 are not identical to each other. As will be described later, even though the shift amount $\tau_d$ is expressed in terms of only the temperature (T+P) of the heating substrate, the temperature compensating accuracy is not much degraded.

The constants $A_1$ and $A_2$ are found based on the shift amount $\tau_d$ and the temperatures of the substrates of two heating elements by using equations 7 and 8 shown below.

$$A_1=\frac{\tau_d}{(\tau_0/\tau_L)\cdot R_2\cdot W+T_{st}-T_0} \quad \text{(Equation 7)}$$

$$A_2=\frac{\tau_d\cdot\{(\tau_0/\tau_L)\cdot R_2\cdot W+T_{st}}{(\tau_0/\tau_L)\cdot R_2\cdot W+T_{st}-T_0} \quad \text{(Equation 8)}$$

According to the method of determining the constants $A_1$ and $A_2$ in the first embodiment, it is unnecessary to conduct experiments of image recording by changing the environmental temperature from a low temperature to a high temperature, but it is possible to find a temperature compensating constant easily by measuring the recorded density of the multitone image only once. Therefore, in the method for determining the temperature compensating constant according to the first embodiment, an appropriate constant can be set to each printer by executing simple processes at the room temperature in mass production, and thus the method is capable of compensating the environmental temperature even if the thermal head 1 has a nonuniform thermal characteristic.

Experiments of tone recording were conducted to find the constants $A_l$ and $A_2$ as follows:

As shown in Table 2, seven different conditions were applied in printing cycle $\tau_L$ and maximum pulse width τmax. Electric power W to be applied to the heating element was set so that 2.2 was obtained as optical density when a pulse width of 0.75 τmax was applied thereto under the above-described reference condition $\{(T+P)=T_{st}+(\tau_0/\tau_L)\times R_2\times W\}$. The value of 0.75τmax was set in consideration of the allocation of the pulse width of the remaining 0.25τmax to the temperature compensating allowance in practical use.

The image described with reference to FIG. 4(A) was recorded at an environmental temperature $T_0\approx 30°$ C. Only the recording of one image is enough for the constant $A_1$ and $A_2$ to be determined as described previously. But in the first embodiment, in order to describe the accuracy of the temperature compensating method of the present invention, two solid images were recorded in the above-described condition, with pulse widths $\tau_0$ varied from each other ($t_0=0.75\times$ τmax and $\tau_0=0.375\times$τmax).

TABLE 1

| recording condition | 1 | 2 | 3 | 4 | 5 | 6 | 7 |
|---|---|---|---|---|---|---|---|
| line cycle $\tau_L$ | 16 ms | 8 ms | 8 ms | 8 ms | 4 ms | 4 ms | 2 ms |
| maximum pulse width τmax | 4 ms | 8 ms | 4 ms | 2 ms | 4 ms | 2 ms | 2 ms |
| applied electric power (per 1dot) | 430 W<br>0.21 W | 184 W<br>0.09 W | 348 W<br>0.17 W | 655 W<br>0.32 W | 246 W<br>0.12 W | 471 W<br>0.23 W | 389 W<br>0.19 W |
| constant $A_1$ ($\times 10^3$ ms/C.°) | −8.44 | −21.6 | −9.53 | −3.67 | −8.59 | −4.45 | −3.28 |
| constant $A_2$ (ms) | 0.426 | 1.45 | 0.618 | 0.241 | 0.711 | 0.348 | 0.343 |
| thermal head | flat glazed head made of thin film manufactured by Matsushita Electronic Components Co., Ltd. | | | | | | |
| article number | TX-CLB5001 | | | | | | |
| resolution | 300 DPI | | | | | | |
| dimension of heating element | 70 × 90 μm | | | | | | |
| number of heating elements | 2048 dots | | | | | | |
| average resistance value | 1017 Ω | | | | | | |
| heat resistance $R_2$ | 0.58 (°C./W) | | | | | | |
| ink sheet | sublimating type ink sheet manufactured by Mitsubishi Kasei Corporation (commercially available) | | | | | | |
| base material | PET (thickness 4.5 μm) | | | | | | |
| recorded color | cyan | | | | | | |

In each of the above-described conditions, the recorded densities of multitone portions of the two images were measured to obtain the shift amount of the $\tau_d$ characteristic function for each multitone image. The temperature (T+P) of the substrate 1*e* of the heating element was found as follows when each multitone image was recorded:

$$(T+P)=T_{st}+(\tau_0/\tau_L)\times R_2\times W$$

FIGS. 5(A)–5(B) show the result of an experiment showing the characteristic of the shift amount $\tau_d$ in the following recording condition 1 (printing cycle 16 ms, maximum pulse width 4 ms).

FIG. 5(A) is a graph showing the relationship between the pulse width τ in the standard state and the shift amount $\tau_d$, the standard state being set as follows:

$$(T+P)=T_{st}+(0.375\times\tau\max/\tau_L)\times R_2\times W=51°\ \text{C.}$$

where $T_{st}$=30° C.

Reference numeral 51 indicates a function in terms of the shift amount $\tau_d$ when the temperature (T+P) of the substrate 1*e* of the heating element is $(T+P)$=28° C. Reference numeral 52 indicates a function of the shift amount $\tau_d$ when the temperature (T+P) of the substrate 1*e* of the heating element is (T+P)=74° C. In the first embodiment, temperature is compensated by supposing that the shift amount $\tau_d$ is constant irrespective of the difference in the pulse width τ. In the conventional temperature compensating method in which pulse width data is multiplied by the compensation coefficient, a temperature compensation is performed by supposing that the shift amount $\tau_d$ is proportional to the pulse width τ. Comparing these two suppositions with the functions 51 and 52 showing the result of the experiment, the supposition of the first embodiment is closer to the shift amount $\tau_d$ than the conventional temperature compensating method. Therefore, the temperature compensating method according to the present invention is capable of compensating for an environmental temperature more accurately than the conventional temperature compensating method.

FIG. 5(B) is a graph showing the relationship between the temperature (T+P) of the substrate 1*e* of the heating element and the shift amount $\tau_d$. The shift amount $\tau_d$ indicates the average of points (circles), the maximum value, and the minimum value of the functions 51 and 52 described with reference to FIG. 5(A).

It was found that the shift amount $\tau_d$ could be expressed in terms of a linear function of the temperature (T+ P) of the substrate 1*e* of the heating element. The slope of the linear function is the constant $A_1$ and the intercept thereof is the constant $A_2$.

FIGS. 6 through 11 show the experimental result showing the characteristic of the shift amount $\tau_d$ in the recording conditions 2 through 7. These result indicate that the higher the printing speed is, the more accurately the printer according to the first embodiment can accomplish a temperature compensation than the conventional printer. Because the shift amount τd gets nearer to constant irrespective of the difference in the pulse width τ, at higher printing speed.

It is understood that the shift amount $\tau_d$ is accurately expressed in terms of a linear function of the temperature (T+P) of the substrate 1*e* of the heating element in any of the above-described condition of experiment. This indicates that the pulse width correction data $\tau_h$(m) to be used for a temperature compensation can be expressed accurately by the simple equation 3 previously described.

In the first embodiment, the constants $A_1$ and $A_2$ obtained from the slopes and intercepts of linear functions are set in the ROM of the γ correcting means 3.

FIG. 12(A) shows a correction error to be used when recording is effected by the printer having the above-described construction. The correction error means the difference between a target recording density and a recording density obtained after the environmental temperature is compensated. Printing cycles 4 ms/line, 8 ms/line, and 16 ms/line shown in FIG. 12A correspond to the recording condition 6, 3, and 1, respectively.

Figure 12B:
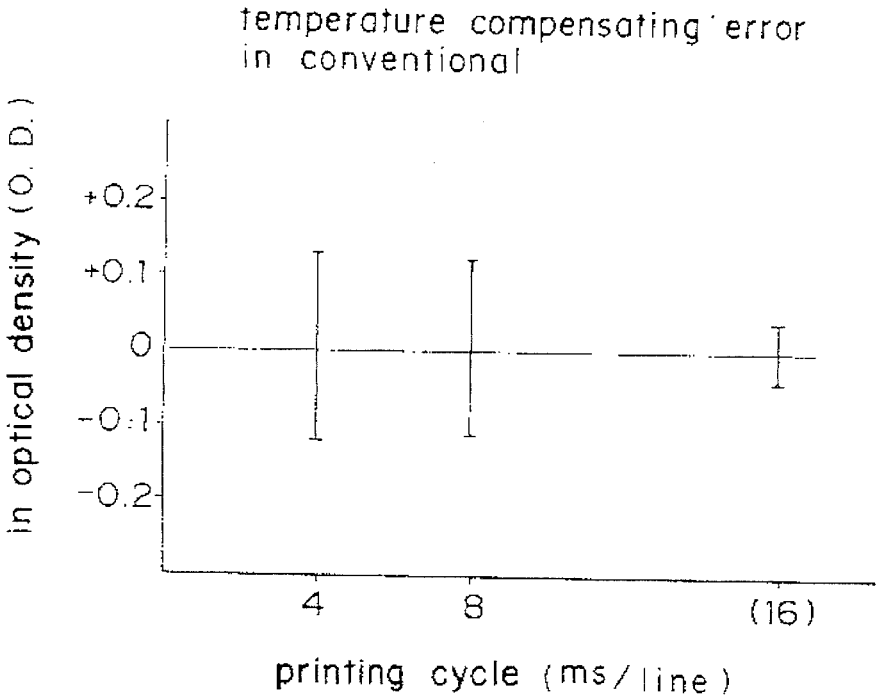

FIG. 12(A) shows the correction error in temperature compensation in the first embodiment. FIG. 12(B) shows the correction error in temperature compensation in the conventional printer.

The constants of both temperature compensating methods are determined so that compensation accuracy is highest in an intermediate density which changes greater than any other densities. Accordingly, the compensation error is great in low and high densities. A density having the greatest correction error is plotted as the error range in FIGS. 12(A)–12(B). If a measured density is higher than the target density, the correction error is set to be positive whereas if a measured density is lower than the target density, the correction error is set to be negative.

As shown in FIGS. 12(A)–12(B), the compensation error of the printer according the present invention about half that of the conventional printer in temperature compensation. That is, the present invention provides a higher degree of temperature compensation.

Table 2 shows the number of calculations performed by the printer according to the first embodiment and the conventional printer in carrying out temperature compensation of one line comprising (n) pieces of pixels.

TABLE 2

| | first embodiment | conventional art |
|---|---|---|
| generation of pulse width correction data | addition and subtraction: twice multiplication: once | addition and subtraction: twice division: twice |
| correction of pulse width | additions and subtractions: n times | multiplication: n times |

A CPU (part No. 6809, manufactured by the Motorola Corp.) is used as the means for determining the pulse width correction data in the first embodiment. Division is not performed but multiplication is performed in the first embodiment, which allows calculations to be performed at a high speed. Since division is not supported as an instruction of the CPU, it is necessary to perform processing of creating a subroutine or the like in performing division and thus it takes more time than multiplication to perform calculations whereas multiplication can be executed by the instruction of the CPU.

A CPU (part No. 6809, manufactured by the Motorola Corp.) is used as the data correcting means in the first embodiment. Additions and subtractions can be performed faster than multiplications. Therefore, the CPU is capable of correcting processing at a high speed. That is, 11 machine cycles are required for one calculation in multiplication whereas two to eight machine cycles are required for one calculation in additions and subtractions. That is, additions and subtractions can be performed about two to six times faster than multiplication. The data correcting means according to the first embodiment performs calculation at a high speed in the case where the number of pixels is great. As apparent from the foregoing description, the printer according to the first embodiment is capable of accomplishing a temperature compensation at a high speed without equipping the printer with a particular computing device.

The printer according to the first embodiment has the above-described features in addition to the feature of the conventional printer described below. The first feature of the conventional printer is that the printer is capable of accomplishing a temperature compensation without delay with respect to a great change in heat reserve amount which occurs every several seconds, because a means for correcting the delay in the detection of temperature is provided in the printer in consideration of heat reserve in a substrate of a heating element of a thermal head. The second feature of the conventional printer is that it is capable of accomplishing a multitone recording not a binary recording. The third feature of the conventional printer is that it is capable of coping with arbitrary input signals or arbitrary recording conditions.

The second embodiment of the present invention is described below with reference to FIG. 13. Similarly to the first embodiment, the printer according to the second embodiment comprises the means 1, 2, 3, 5 through 8. The pulse width averaging means 61 averages the first pulse width data $\{\tau(m, i)\sim\tau(m, n)\}$ to be corrected outputted from the $\gamma$ correcting means 3. Then, the pulse width correction data $\tau_h$ outputted from the correction data determining means 9 is added to the averaged value. Thus, the pulse width averaging means 61 outputs the average pulse width data $\tau_{av}(m)$ to the data cumulating means. The temperature compensating effect of the printer according to the second embodiment is similar to that of the printer according to the first embodiment.

The third embodiment of the present invention is described below with reference to FIG. 14. Similarly to the first embodiment, the printer according to the third embodiment comprises the means 1 through 5, 7, 8, and 9. The correction data determining means 70 generates a correction coefficient k(m) and pulse width correction data $\tau'_h(m)$ in response to the output P(m) of the data cumulating means and the output T(m) of the temperature detection means 8 by using equations 9 and 10. The correction data determining means 70 comprises a ROM which outputs the correction coefficient k(m) and the pulse width correction data $\tau'_h(m)$ to the multiplying means 71 and the adding means 72, respectively in response to the output of the data cumulating means and that of the temperature detection means 8.

$$k(m) = \frac{A_4 + T_{st} + (\tau_0/\tau_L) \cdot R_2 \cdot W}{A_4 + T(m) + P(m)} \quad \text{(Equation 9)}$$

$$\tau_h'(m) = A_5 \cdot (T(m) + P(m)) + A_5 \quad \text{(Equation 10)}$$

$$\tau'_h(m) = A_5 \cdot (T(m) + P(m) + A_5 \quad \text{(Equation 10)}$$

where $A_4$, $A_5$, and $A_6$ are constants.

A multiplying means 71 multiplies the correction coefficient k(m) by the pulse width data $\tau(m,i)$ to be corrected outputted from the $\gamma$ correcting means 3, thus outputting $k(m)\tau(m,i)$ to an adding means 72. The adding means 72 adds the pulse width correction data $\tau'_h(m)$ to the output $k(m)\tau(m,i)$ of the multiplying means 71, thus outputting $k(m)\tau(m,i)+\tau'_h(m)$ to the head driving means 5.

The temperature compensation in the third embodiment is equivalent to the temperature compensation made by supposing that the functions 51 and 52 are linear functions in terms of the pulse width $\tau$ in the reference state. The temperature compensation in the third embodiment is capable of reducing compensation error resulting from the supposition that the functions 51 and 52 are constant with respect to the pulse width $\tau$ in the reference state, thus accomplishing a more accurate temperature compensation.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

What is claimed is:

1. A printer for recording a multitone image for each printing line comprising:

a γ correcting means for converting tonal data including at least one of density data and luminance data supplied thereto into corresponding first pulse width data required to obtain a predetermined recording density;

a data correcting means for converting the first pulse width data into second pulse width data by at least adding pulse width correction data to the first pulse width data;

a thermal head comprising a plurality of heating elements formed on a supporting member;

a head driving means for driving each of said heating elements of the thermal head according to the second pulse width data;

a temperature detection means for providing an output representing a temperature in a portion of the supporting member of the thermal head;

a data cumulating means for providing an output obtained by cumulating data, substantially corresponding to the second pulse width data, for each printing line; and a correction data determining means for determining at least the pulse width correction data based on the output of the temperature detection means and that of the data cumulating means.

2. A printer as defined in claim 1, wherein supposing that the output of the temperature detection means is T and the output of the data cumulating means is P, the correction data determining means generates the pulse width correction data $\tau_h$ based on the following equation:

$$\tau_h = A_1 \times (T+P) + A_2$$

where $A_l$ and $A_2$ are constants.

3. A printer as defined in claim 2, wherein, in the m-th printing line (m is a natural number) the average value of each of the second pulse width data corresponding to each of the heating elements of the thermal head is $\tau_{av}(m)$, and the data cumulating means provides an output P(m) in accordance with the following equation;

$$P(m) = \alpha \cdot P(m-1) + (1-\alpha) \cdot A_3 \cdot \tau_{av}(m-1)$$

where α is a constant of $0<\alpha<1$, $A_3$ is a constant, and $P(0)=0$.

4. A printer as defined in claim 1, further comprising: correction data determining means for generating a pulse width correction coefficient and the pulse width correction data based on the output of the temperature detection means and that of the data cumulating means; and data correcting means for multiplying the output of the γ correcting means by the pulse width correction coefficient and adding the pulse width correction data thereto.

5. A printer as defined in claim 4, wherein supposing that the output of the temperature detection means is T and the output of the data cumulating means is P, the correction data determining means generates pulse width correction coefficient K based on the following equation:

$$K = \frac{A_5}{A_4 + T + P}$$

6. A printer as defined in claim 4, wherein supposing that the output of the temperature measuring means is T and the output of the data cumulating means is P, the correction data determining means generates pulse width correction data $\tau'_h$ based on the following equation:

$$\tau'_h = A_6 \times (T+P) + A_7$$

where $A_6$ and $A_7$ are constants.

7. A printer for recording a multitone image for each printing line comprising:

a γ correcting means for converting tonal data including at last one of density data and luminance data supplied thereto into corresponding first pulse width data required to obtain a predetermined recording density;

a data correcting means for converting the first pulse width data into second pulse width data by at least adding pulse width correction data to the first pulse width data;

a thermal head comprising a plurality of heating elements formed on a supporting member;

a head driving means for driving each of said heating elements of the thermal head according to the second pulse width data;

a temperature detection means for providing an output representing a temperature in a portion of the supporting member of the thermal head;

a data cumulating means for providing an output obtained by cumulating the inputs of the first pulse width data and the pulse width correction data for each printing line; and a correction data determining means for determining at least the pulse width correction data based on the output of the temperature detection means and that of the data cumulating means.

8. A printer as defined in claim 7, further comprising: a correction data determining means for generating pulse width correction coefficient and the pulse width correction data based on the output of the temperature detecting means and that of the data cumulating means; and a data correcting means for multiplying the output of the γ correcting means by the pulse width correction coefficient and adding the pulse width correction data to the output of the multiplying means.

9. A method for determining a temperature compensation coefficient of a printer including a thermal head comprising a plurality of heating elements, said method comprising:

a first recording process of recording including grouping the heating elements of the thermal head into plural groups and applying pulses of stepped different widths respectively to the groups, thereby allowing a recording operation for a predetermined time in a sub-scanning direction to be made;

a second recording process of recording a solid image by uniformly applying a predetermined pulse width to each heating element of the thermal head;

a third recording process of recording including grouping the heating elements of the thermal head into plural groups and applying pulses of stepped different widths respectively to the groups, thereby allowing a recording operation for a predetermined time in a sub-scanning direction to be made;

a density measuring process of measuring the density of the image formed in the first and third recording processes, thus obtaining two γ characteristic functions indicating the relationship between the pulse width and the density of the image; and a constant determining process for determining a temperature compensation constant based on the two γ characteristic functions.

* * * * *